US010190562B2

(12) United States Patent
Maeda et al.

(10) Patent No.: US 10,190,562 B2
(45) Date of Patent: Jan. 29, 2019

(54) ENGINE START DETERMINING APPARATUS

(71) Applicant: MITSUBISHI JIDOSHA KOGYO KABUSHIKI KAISHA, Tokyo (JP)

(72) Inventors: Satoshi Maeda, Tokyo (JP); Hideo Matsunaga, Tokyo (JP); Hitoshi Kamura, Tokyo (JP); Koetsu Fujiwara, Tokyo (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 320 days.

(21) Appl. No.: 14/075,000

(22) Filed: Nov. 8, 2013

(65) Prior Publication Data

US 2014/0144403 A1 May 29, 2014

(30) Foreign Application Priority Data

Nov. 27, 2012 (JP) ..... 2012-258666

(51) Int. Cl.
*F02N 11/08* (2006.01)
*F02N 11/04* (2006.01)

(52) U.S. Cl.
CPC ..... *F02N 11/0848* (2013.01); *F02N 11/04* (2013.01); *F02N 2200/022* (2013.01)

(58) Field of Classification Search
CPC . F02N 11/0848; F02N 11/04; F02N 2200/022
See application file for complete search history.

(56) References Cited

U.S. PATENT DOCUMENTS 4,471,653 A * 9/1984 Kawamura et al. ..... 73/114.26
6,274,943 B1 * 8/2001 Hasegawa et al. ..... 290/40 C
6,291,902 B1 * 9/2001 Ogane ..... B60K 6/485 123/179.1
6,379,284 B1 * 4/2002 Hanai et al. ..... 477/200
6,622,702 B2 * 9/2003 Yomogida et al. ..... 123/478
6,973,383 B2 * 12/2005 Mitsutani ..... F02D 31/003 123/179.3
7,463,958 B2 * 12/2008 Suzuki ..... B60W 10/06 180/65.28
7,653,478 B2 * 1/2010 Park ..... B60K 6/48 123/179.4
2002/0161507 A1 * 10/2002 Fuse ..... B60K 6/48 701/112
2004/0044461 A1 * 3/2004 Ueda ..... F02D 41/1498 701/111
2004/0050368 A1 * 3/2004 Kitagawa ..... F02D 41/064 123/480

(Continued)

FOREIGN PATENT DOCUMENTS

JP 08-261118 A 10/1996
JP 2000-186654 A 7/2000

*Primary Examiner* — Hung Q Nguyen
*Assistant Examiner* — Brian P Monahon
(74) *Attorney, Agent, or Firm* — Birch, Stewart, Kolasch & Birch, LLP

(57) ABSTRACT

An apparatus includes a dynamo-electric machine driving an engine, and a calculator calculating an increment in a crank angular acceleration of the engine every certain period from a base time after the driving of the engine by the dynamo-electric machine. The apparatus further includes a determiner determining that the engine has started by the dynamo-electric machine on a condition that the increment calculated by the calculator exceeds a standard value.

6 Claims, 3 Drawing Sheets

(56) References Cited

U.S. PATENT DOCUMENTS

2004/0084002 A1* 5/2004 Mitsutani ..... F02D 41/021 123/179.4
2006/0030997 A1* 2/2006 Ozeki ..... B60L 11/14 701/112
2006/0037568 A1* 2/2006 Arinaga et al. ..... 123/90.15
2007/0234990 A1* 10/2007 Shiino et al. ..... 123/179.16
2008/0105230 A1* 5/2008 Kishibata ..... F02D 41/062 123/179.5
2008/0154455 A1* 6/2008 Hidaka ..... B60K 6/48 701/22
2008/0216779 A1* 9/2008 Watanabe ..... F02D 13/06 123/90.15
2008/0264374 A1* 10/2008 Harris ..... E02F 9/20 123/179.3
2009/0159042 A1* 6/2009 Nakagawa ..... F02P 5/1506 123/334
2009/0199818 A1* 8/2009 Sata ..... F02D 41/0025 123/406.58
2009/0312144 A1* 12/2009 Allgaier ..... B60K 6/48 477/5
2010/0072958 A1* 3/2010 Wada ..... B60K 1/00 322/22
2010/0242905 A1* 9/2010 Machida ..... F02N 11/0844 123/339.14
2010/0268433 A1* 10/2010 Ueda ..... F02D 31/001 701/102
2010/0324762 A1* 12/2010 Imaseki ..... B60K 6/36 701/22
2012/0035827 A1* 2/2012 Kuniyoshi ..... F02N 11/0855 701/102
2012/0123666 A1* 5/2012 Stoffels ..... F01M 1/02 701/113
2012/0292919 A1* 11/2012 Suzuki ..... B60K 6/48 290/38 C

* cited by examiner

ENGINE START DETERMINING APPARATUS

CROSS-REFERENCE TO THE RELATED APPLICATION

This application incorporates by references the subject matter of Application No. 2012-258666 in Japan on Nov. 27, 2012 on which a priority claim is based under 35 U.S.C. S119(a).

FIELD

The present invention relates to an engine start determining apparatus related to the determination of the start-up of an engine when a dynamo-electric machine starts the engine.

BACKGROUND

In a hybrid vehicle having an engine and a dynamo-electric machine, a technique has been known using a motor generator as a self-starting motor (starter motor) for an engine. That is, the motor generator cranks and starts the engine. The motor generator mounted in this type of vehicle has higher power in comparison with a self-starting motor, and thus is capable of cranking with relatively high rotational speed. As the rotation upon cranking of the engine increases, however, the discrimination of the self-sustaining revolution of the engine from the revolution dependent on the output from the motor generator becomes more difficult; hence, the start-up of the engine cannot be readily determined.

To solve this problem, techniques for determining the engine start-up based on both the engine speed and the operational state of the motor generator have been studied. For example, one technique measures an elapsed time since the output from the motor generator fell below a reference value during cranking, and determines that the engine has started when the engine speed after the elapse of a predetermined time (a base time) is a predetermined speed (a base speed) or higher (e.g., see Patent Literature 1; Japanese Unexamined Patent Application Publication No. 2000-186654). Another technique drives an engine with an increased torque instruction value of the motor generator, then temporarily cancels the torque assist, and determines that the engine has started if the engine speed does not drop in this state (e.g., see Patent Literature 2; Japanese Unexamined Patent Application Publication No. H8-261118). These techniques can determine the self-sustaining revolution of the engine.

According to these conventional techniques, however, the determination of the engine start-up takes time, thereby precluding proper control of the engine. For example, the technique disclosed in Patent Literature 1 (Japanese Unexamined Patent Application Publication No. 2000-186654) requires the sum of a first elapsed time from the start of cranking to a time when the output from the motor generator falls below the reference value and a second elapsed time after the output fell below the reference value. The time for determining the engine start-up thus cannot be shorter than the sum of the elapsed times. The same can also be applied to the technique disclosed in Patent Literature 2 (Japanese Unexamined Patent Application Publication No. H8-261118). That is, the time for the determination of the engine start-up depends on the setting time until the torque assist is temporarily canceled.

Another potential technique determines that the engine has started based on an elapsed time after the start of fuel injection, without confirmation of the engine speed or the operational state of the motor generator. This technique, however, may erroneously determine the engine start-up even if the engine is not spontaneously revolving, and cannot improve the accuracy of the determination.

Thus, these conventional techniques barely achieve both a reduction in the time for engine start-up determination and an improvement in the accuracy of the determination at the same time.

SUMMARY

Technical Problems

An object of the present invention, which has been accomplished in view of the above problems, is to provide an engine start determining apparatus that can determine the engine start-up at high accuracy within a short time after a dynamo-electric machine starts the engine. Another object of the present disclosure is to provide novel advantageous effects that are derived from the individual features described in the Description of Embodiments below but not conventional techniques.

Solution to Problems (1) An engine start determining apparatus according to one aspect of the present disclosure includes a dynamo-electric machine driving an engine, and a calculator calculating an increment in a crank angular acceleration of the engine every certain period from a base time after the driving of the engine by the dynamo-electric machine. Furthermore, the engine start determining apparatus includes a determiner determining that the engine has started by the dynamo-electric machine on a condition that the increment calculated by the calculator exceeds a standard value.

Examples of the dynamo-electric machine herein include a device having both the motor function and the generator function (e.g., motor generator) and a device having only the motor function. The crank angular acceleration herein indicates an angular acceleration of a crank shaft of the engine.

(2) The determiner preferably determines that the engine has started on a condition that the increments in the crank angular acceleration until the end of a certain period and until the end of the preceding certain period both exceed the standard value.

(3) The calculator preferably calculates the increment in the crank angular acceleration of the engine every period of piston stroke. That is, the certain period is preferably a stroke of the engine (a period of piston stroke). For example, the calculator preferably calculates the crank angular acceleration every time when the crankshaft of the engine has rotated by 180 degrees.

(4) The stroke of the engine is preferably a spark-ignition period of the engine or a compression-ignition period of the engine. For example, the calculator preferably calculates the crank angular acceleration every ignition by a spark plug of the engine or every ignition and combustion of the air-fuel mixture within a combustion chamber.

(5) The determiner preferably sets the standard value based on an amount of intake air of the engine and an angular velocity of the crank shaft. Preferable specific examples of the parameter corresponding to the amount of intake air of the engine include the charging efficiency and volumetric efficiency of the engine.

Advantageous Effects

The engine start determining apparatus according to the present disclosure can rapidly determine the accurate momentum of the spontaneous revolution of an engine after a dynamo-electric machine cranks the engine. This can determine the engine start-up within a short time with improved accuracy at the same time.

BRIEF DESCRIPTION OF DRAWINGS

The nature of this invention, as well as other objects and advantages thereof, will be explained in the following with reference to the accompanying drawings, in which like reference characters designate the same or similar parts throughout the figures and wherein:

FIG. 4 (*a*) is a graph illustrating the number Ne of revolutions of the engine (engine speed Ne); FIG. 4(*b*) is a graph illustrating an angular acceleration (a) of a crank shaft; FIG. 4 (*c*) is a graph illustrating a fuel injection volume; and FIG. 4(*d*) is a graph corresponding to the part A in FIG. 4(*b*) and illustrating the change in a sensor value (sampled value) of the crank angular acceleration (a).

DESCRIPTION OF EMBODIMENTS

The embodiments will now be described with reference to the accompanying drawings. The embodiments below are only examples and do not intend to exclude Application of various modifications or techniques that are not described in the embodiment. The individual features of the embodiments may be variously modified within their scopes, and may be selectively employed as necessary or properly combined with one another.

[1. Configuration of Device]

Figure 1:
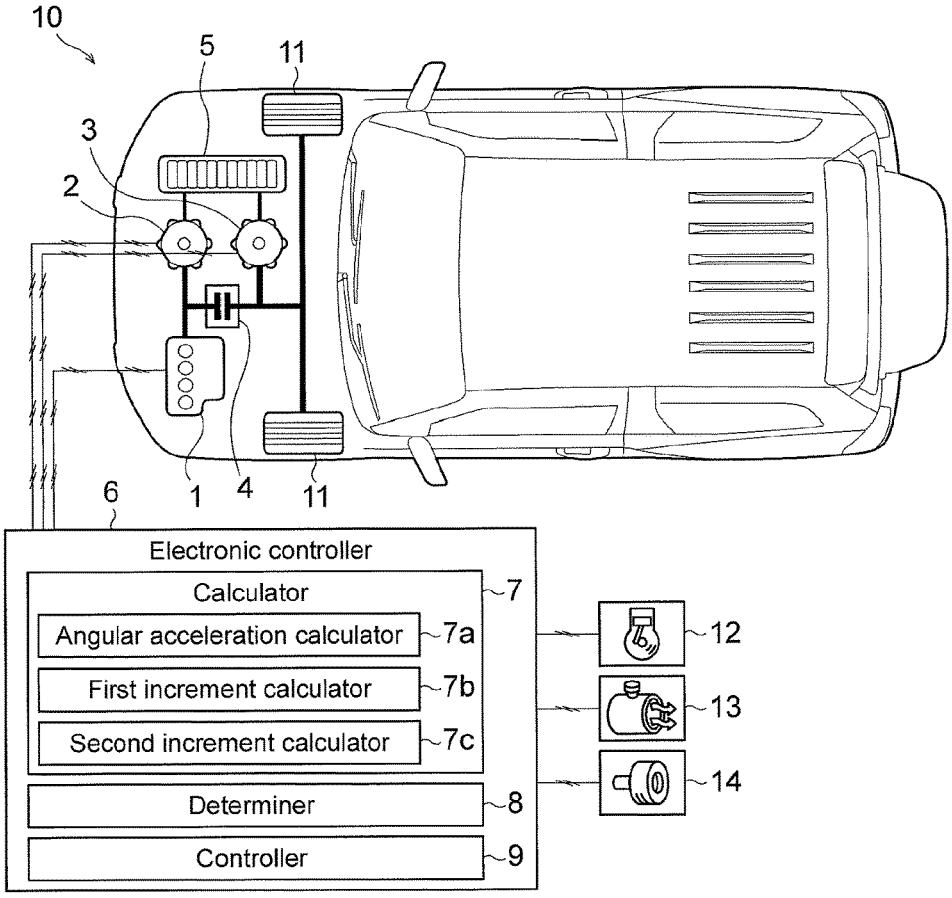
FIG. 1 is a diagram illustrating the configuration of a vehicle provided with an engine start determining apparatus according to an embodiment, and the block configuration of the engine start determining apparatus.

An engine start determining apparatus according to the present embodiment is applied to a hybrid vehicle 10 illustrated in FIG. 1. The vehicle 10 is provided with an engine 1 as a drive source, a motor 3 as another drive source, and a motor generator 2 (dynamo-electric machine) having both the motor function and the generator function.

The engine 1 is an internal combustion engine (gasoline or diesel engine) using gasoline or light oil, for example, a four-cylinder four-cycle engine. A clutch 4 controlling the transmission state of driving force and the magnitude of torque to be transmitted to the drive wheels 11 is provided in the power transmission path connecting between the engine 1 and the drive wheels 11. Furthermore, the power transmission path is connected with the motor generator 2 adjacent to the engine 1 and with the motor 3 adjacent to the drive wheels 11, which are opposite the clutch 4. A transmission mechanism in the power transmission path is not depicted in FIG. 1.

As illustrated in FIG. 1, the motor generator 2 and the motor 3 are both connected with a battery 5. The motor 3 operates mainly on the electric power stored in the battery 5 and supplies driving force to the drive wheels 11. The motor generator 2 operates mainly on the driving force generated by the engine 1 and charges the battery 5 with electric power. In contrast, at the start-up of the engine 1, the motor generator 2 operates on the electric power from the battery 5 and transmits the driving force to the engine 1. The engine 1 is manipulated to start while the clutch 4 is disconnected. The engine 1 is connected to the motor generator 2 directly or via a transmission mechanism, which structure can transmit the driving force therebetween regardless of the connection or disconnection of the clutch 4.

The overall operational states of the engine 1, the motor generator 2, and the motor 3 are controlled with an electronic controller 6. The electronic controller 6 includes an LSI (Large Scale Integration) device including a microprocessor, a ROM (Read Only Memory), and a RAM (Random Access Memory), which are integrated, or an embedded electronic device, for example. The controller 6 is connected with a communication line of an in-vehicle network of the vehicle 10. In the in-vehicle network, various known electronic controllers, such as a brake controller, a transmission controller, a vehicle stability controller, an air-conditioning controller, and an electrical-component controller, are connected so as to be communication with one another. Among the controls by the electronic controller 6, the following description begins with the start control for the engine 1 with the motor generator 2, in particular, the control for the determination of the start-up of the engine 1.

[2. Configuration of Control]

As illustrated in FIG. 1, the electronic controller 6 is connected with an engine speed sensor 12, an airflow sensor 13, and a vehicle speed sensor 14. The engine speed sensor 12 acquires the number Ne of revolutions of the engine 1 (engine speed Ne), typically based on a variation per unit time in the rotational angle (angular velocity) of the crank shaft. For example, the calculation of the number Ne of revolutions is based on a time required for a 180-degree turn of the crank shaft. In the present embodiment, the number Ne of revolutions is acquired every stroke (i.e., every time the crank shaft turns by 180 degrees).

The airflow sensor 13 detects the flow rate Q (mass air flow) of intake air to be introduced into each cylinder of the engine 1, for example, the flow rate of the intake air passing through a throttle valve. The vehicle speed sensor 14 detects the speed V (travel speed) of the vehicle 10, for example, the rotational speed of the drive wheels 11 or other wheels. The number Ne of revolutions of the engine 1, the flow rate Q of intake air, and the speed V of the vehicle, which are acquired by the sensors 12, 13 and 14, each are transmitted to the electronic controller 6 as needed.

The electronic controller 6 is provided with a calculator 7, a determiner 8, and a controller 9. The individual functions of these components may be achieved by electronic circuits (hardware), or may be programmed as software. Alternatively, some of the functions may be provided in the form of hardware while the other may be provided in the form of software.

The calculator 7 calculates an increment in the crank angular acceleration (a) of the engine 1. The crank angular acceleration (a) indicates the angular acceleration (a) of the crank shaft of the engine 1, and corresponds to the change rate of the number Ne of revolutions of the engine per unit time. In contrast, the increment in the crank angular acceleration (a) is an increment for a base elapsed time, and is not necessarily completely consistent with the change rate of the crank angular acceleration (a) per unit time (i.e., temporal gradient). The calculator 7 is provided with an angular acceleration calculator 7*a*, a first increment calculator 7*b*, and a second increment calculator 7*c*.

The angular acceleration calculator 7*a* calculates a crank angular acceleration (a) from the number Ne of revolutions of the engine. For example, where $Ne_n$ indicates a current value and $Ne_{n-1}$ indicates the preceding value among the numbers Ne that are sequentially received in response to the rotational period of the crank shaft, the angular acceleration calculator 7*a* calculates a difference in acquisition time between the current value $Ne_n$ and the preceding value $Ne_{n-1}$, and calculates the crank angular acceleration (a) based on the quotients of the difference between the current value $Ne_n$ and the preceding value $Ne_{n-1}$ divided by the difference in acquisition time. Since the number Ne of revolutions of the engine is acquired every stroke in the present embodiment, the crank angular acceleration (a) is also calculated every stroke. The calculated crank angular acceleration (a) is transmitted to the first increment calculator 7*b* and the second increment calculator 7*c*.

Figure 2:
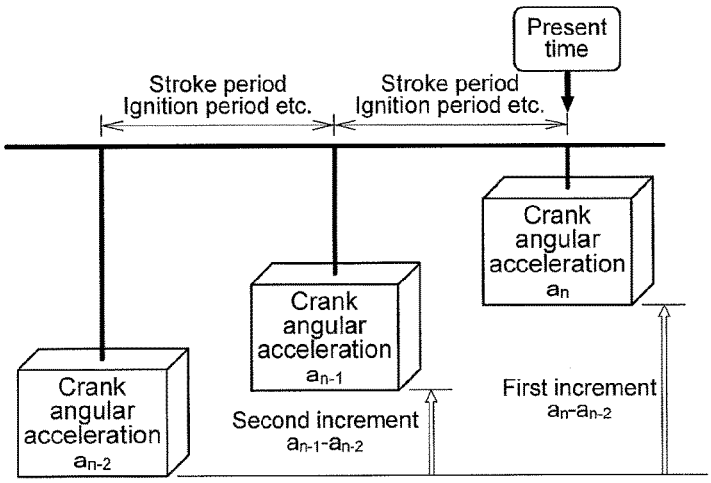
FIG. 2 is a schematic diagram for explanation of the determination by the engine start determining apparatus.

The first increment calculator 7*b* calculates the increment in the crank angular acceleration (a) between a time interval from a past reference time to the current time. In the present embodiment, the first increment calculator 7*b* calculates the first increment ($a_n-a_{n-2}$) by subtracting the second-preceding crank angular acceleration ($a_{n-2}$) from the current crank angular acceleration ($a_n$), which are calculated by the angular acceleration calculator 7*a*, as illustrated in FIG. 2. In other words, the first increment calculator 7*b* calculates the amount of an increase in the crank angular acceleration (a) during the two strokes in comparison with the crank angular acceleration ($a_{n-2}$) at the second-preceding stroke. The calculated first increment ($a_n-a_{n-2}$) is transmitted to the determiner 8.

The second increment calculator 7*c* calculates an increment in the crank angular acceleration (a) between two past time points. In the present embodiment, the second increment calculator 7*c* calculates the amount of an increase in the crank angular acceleration (a) from a time the base time before the current time for a second base time shorter than the base time. The second increment calculator 7*c* calculates the second increment ($a_{n-1}-a_{n-2}$) by subtracting the second-preceding crank angular acceleration ($a_{n-2}$) from the preceding crank angular acceleration ($a_{n-1}$), which are calculated by the angular acceleration calculator 7*a*, as illustrated in FIG. 2. In other words, the second increment calculator 7*c* calculates the amount of an increase in the crank angular acceleration (a) during the single stroke in comparison with the crank angular acceleration ($a_{n-2}$) at the second-preceding stroke. The calculated second increment ($a_{n-1}-a_{n-2}$) is transmitted to the determiner 8.

The above-described first increment calculator 7*b* and second increment calculator 7*c* function as an angular-acceleration increment calculator calculating increments (a first increment and a second increment) in the crank angular acceleration (a) of the engine 1 every certain period (period of a single stroke) from a base time point (two strokes before the current time) after the motor generator 2 drives the engine 1.

The determiner 8 determines whether the motor generator 2 has started the engine 1 based on the comparison of the first increment ($a_n-a_{n-2}$) and second increment ($a_{n-1}-a_{n-2}$) with a standard value. In the present embodiment, when both the first increment ($a_n-a_{n-2}$) and the second increment ($a_n-a_{n-2}$) exceed a standard value $\Delta a_{st}$ after the start of fuel injection, the determiner 8 determines the start-up of the engine 1 (start of spontaneous revolution). That is, the engine 1 is determined to have started when successive increments of the crank angular acceleration (a) of the engine 1 exceed the standard value $\Delta a_{st}$. In contrast, when this condition is not satisfied, the determiner 8 does not determine the start-up of the engine 1 (no start of spontaneous revolution). For example, if only one of the first increment ($a_n-a_{n-2}$) and the second increment ($a_{n-1}-a_{n-2}$) exceeds the standard value $\Delta a_{st}$ (the other does not exceed the standard value $\Delta a_{st}$), the determiner 8 determines that the engine 1 has not started yet (no start of spontaneous revolution). The results of the determination are transmitted to the controller 9.

The standard value $\Delta a_{st}$ is established based on the amount of intake air and the number Ne of revolutions of the engine 1. For example, as the amount of the intake air increases, the standard value $\Delta a_{st}$ increases; otherwise, as the number Ne of revolutions of the engine increases, the standard value $\Delta a_{st}$ increases. Specific examples of the parameter corresponding to the amount of intake air of the engine 1 include the charging efficiency Ec and the volumetric efficiency Ev of the engine 1. The charging efficiency Ec is obtained by dividing the mass of intake air introduced at an intake stroke by the mass of air corresponding to the stroke volume under standard atmosphere. The volumetric efficiency Ev is obtained by dividing the mass of intake air introduced at an intake stroke by the mass of air corresponding to the stroke volume under the same atmosphere as the measurement of the mass of intake air. These values are calculated based on the flow rate Q of intake air observed with the airflow sensor 13. The determiner 8 calculates the standard value $\Delta a_{st}$, for example, using a control map or an expression including the amount of intake air and the number Ne of revolutions of the engine as arguments that defines the relationship among the amount of intake air, the number Ne of revolution of the engine, and the standard value $\Delta a_{st}$.

The controller 9 executes various controls related to the operational states of the engine 1 and the motor generator 2 in response to the results of determination by the determiner 8. In the present embodiment, the driving force of cranking by the motor generator 2 is controlled to gradually decrease, based on the time of determination that the engine 1 has started, for example. Also, the timing of the start of miss-fire monitoring control for predicting occurrence of an abnormal state such as failure in a spark plug of the engine 1 or miss fire, is established based on the time of determination that the engine 1 has started. In addition, the timing of connecting the clutch 4 is also established based on the timing of the start-up of the engine 1. Thus, the controller 9 controls various devices in the vehicle 10 based on the results of the determination regarding whether the engine 1 has started or not.

[3. Flowchart]

Figure 3:
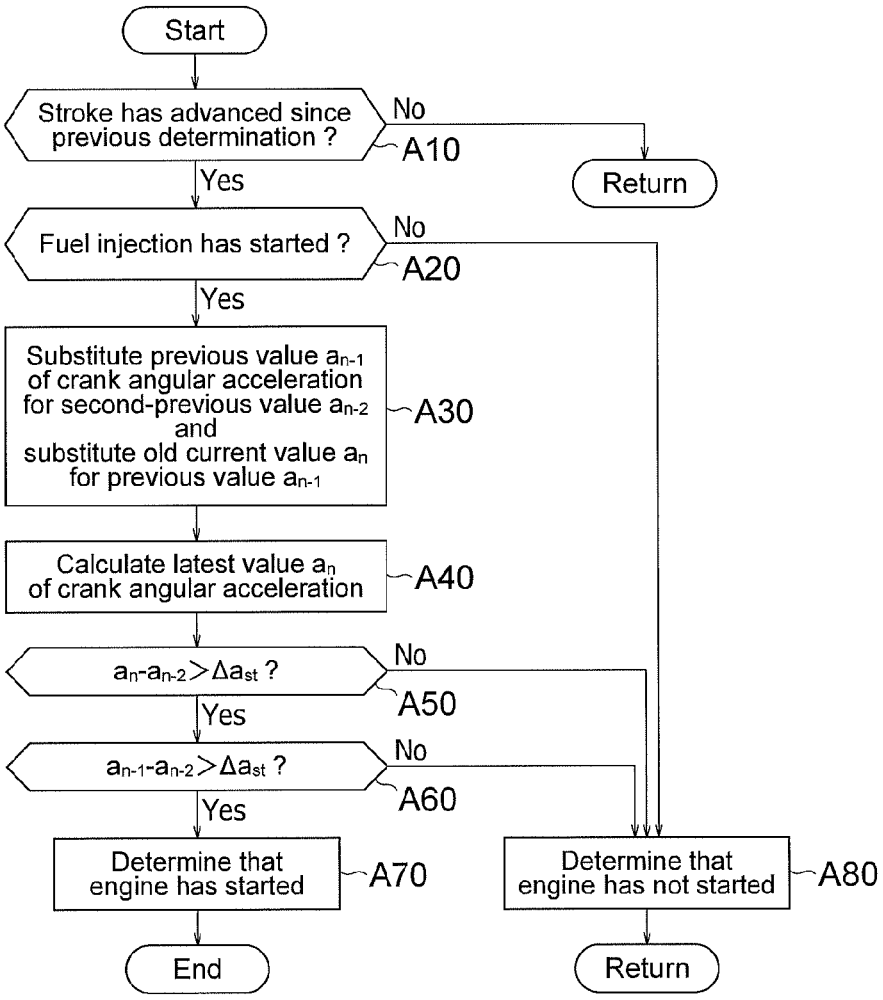
FIG. 3 is a flowchart for explanation of the control by the engine start determining apparatus.
Figure 4A:
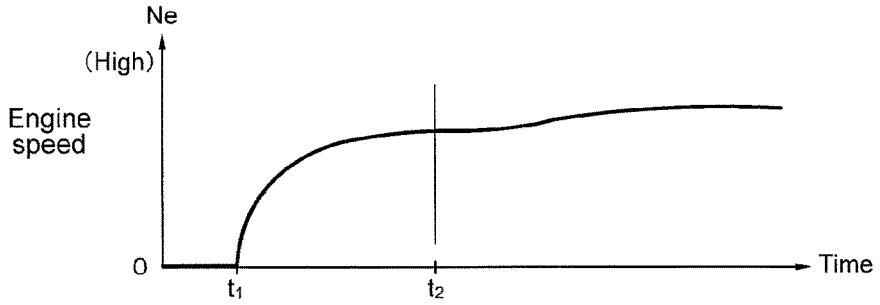
FIGS. 4(*a*) to 4(*d*) are time charts for explanation of the state of an engine mounted in the vehicle illustrated in FIG. 1 at the engine start-up.
Figure 4B:
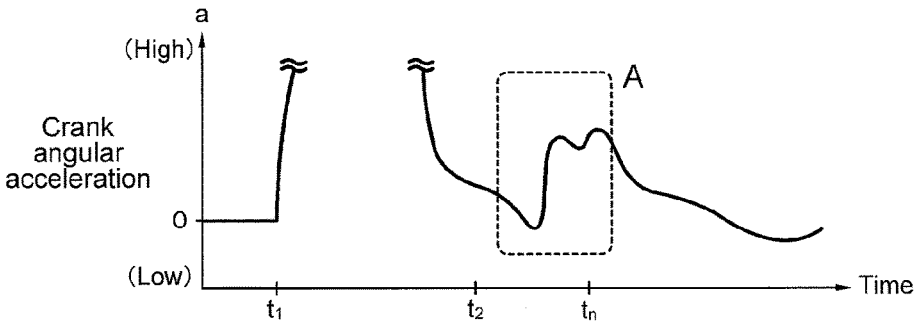
Figure 4C:
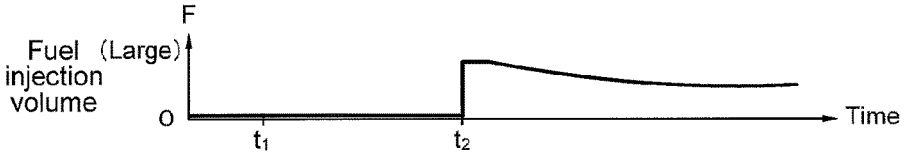
Figure 4D:
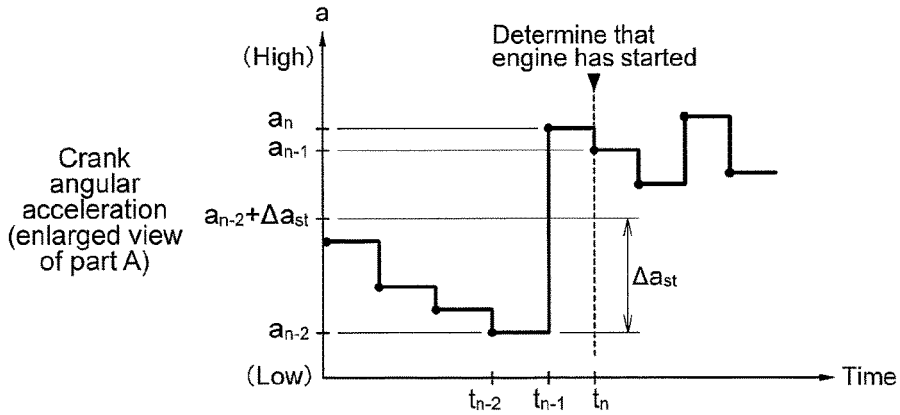

The flowchart in FIG. 3 illustrates a process of the determination of the start-up. This process is executed when the motor generator 2 starts to crank the engine 1, and is repeated until the engine 1 is determined to have started. The execution period of the process is appropriately set, and is shorter than the calculation period of a crank angular acceleration (a) (e.g., several milliseconds or less) in the present embodiment. The execution period of such a control process related to the determination of the engine start-up is preferably shorter than at least one of the stroke period, the spark-ignition period, and the compression-ignition period upon the start-up of the engine 1.

In step A10, whether the stroke has advanced (whether the crank shaft has rotated by 180 degrees, or whether a period corresponding to a single stroke of the engine 1 has elapsed) after the preceding determination, is determined. The preceding determination herein indicates the determination in step A70 or A80 explained below. When the stroke has not advanced, this process at this control period is terminated. When no determination has been executed before or when the stroke has advanced after the preceding determination, the process proceeds to step A20.

In step A20, whether the fuel injection of the engine 1 has started is determined. If the fuel injection has already started, then the process proceeds to step A30; else the process proceeds to step A80 and the determiner 8 determines that "the engine 1 has not started," and then the determination at this control period is terminated.

In step A30, the calculator 7 substitutes the preceding crank angular acceleration value ($a_{n-1}$) for the second-preceding value ($a_{n-2}$), and substitutes the current value ($a_n$) for the preceding value ($a_{n-1}$). That is, the calculator 7 replaces the second-preceding value ($a_{n-2}$) by the preceding crank angular acceleration value ($a_{n-1}$), and then the calculator 7 replaces the preceding value ($a_{n-1}$) by the current value ($a_n$).

In step A40, the angular acceleration calculator 7*a* recalculates the current crank angular acceleration value ($a_n$). The calculator 7 thus retains not only the latest crank angular acceleration calculated at the current calculation period but also crank angular accelerations calculated at the two preceding calculation periods, that is, three crank angular accelerations.

In step A50, the first increment calculator 7*b* calculates the first increment ($a_n-a_{n-2}$) and the determiner 8 determines whether the first increment ($a_n-a_{n-2}$) is larger than the standard value $\Delta a_{st}$. If the inequality $(a_n-a_{n-2})>\Delta a_{st}$ is satisfied, then the process proceeds to step A60; else the process proceeds to step A80.

In step A60, the second increment calculator 7*c* calculates the second increment ($a_{n-1}-a_{n-2}$), and the determiner 8 determines whether the second increment ($a_{n-1}-a_{n-2}$) is larger than the standard value $\Delta a_{st}$. If the inequality $(a_{n-1}-a_{n-2})>\Delta a_{st}$ is satisfied, then the process proceeds to step A70 and the determiner 8 determines that "the engine 1 has started" and then the process is terminated; else the process proceeds to step A80 and the determiner 8 determines that "the engine 1 has not started yet" and the process is repeated until the determiner 8 determines that "the engine 1 has started."

[4. Operation and Advantageous Effects]

FIGS. 4(*a*) to 4(*d*) illustrate changes in the number Ne of revolutions of the engine, the crank angular acceleration (a), and the fuel injection volume at the start-up of cranking the engine 1 by the motor generator 2. For example, if a predetermined engine start condition is satisfied during running of the vehicle 10 by the driving force of only the motor 3, the motor generator 2 is controlled to start the engine 1. For example, the predetermine engine start condition is satisfied when the vehicle speed V reaches a predetermined speed or higher, and then the motor generator 2 starts to crank the engine 1. The clutch 4 is disconnected, so that the driving force generated by the motor 3 is transmitted to the drive wheels 11, and the driving force generated by the motor generator 2 is transmitted to the engine 1.

As illustrated in FIG. 4(*a*), when the cranking starts at the time $t_1$, the number Ne of revolutions of the engine 1 significantly increases. The rotational speed of the cranking by the motor generator 2, however, is higher than those of general self-starting motors, and therefore the spontaneous revolution of the engine 1 cannot be easily discriminated from the revolution dependent on the output from the motor generator 2. Accordingly, the start-up of the engine 1 based on the number Ne of revolutions cannot be easily determined with high accuracy.

In contrast, in the vehicle 10, the determination of the start-up of the engine 1 is based on the change in the angular acceleration (a) of the crankshaft of the engine 1. The change in the crank angular acceleration (a) reflects the increasing momentum of the number Ne of revolutions of the engine 1. Accordingly, as illustrated in FIG. 4(*b*), the crank angular acceleration (a) rapidly increases immediately after the cranking, and decreases as the number Ne of revolutions of the engine 1 approaches the rotational speed of the motor generator 2. Even if the fuel injection starts at the time $t_2$, the crank angular acceleration (a) does not greatly increase unless the air-fuel mixture in the cylinders is spark-ignited or compression-ignited. In contrast, if the air-fuel mixture in the cylinders is spark-ignited or compression-ignited, the crank angular acceleration (a) rapidly increases.

If the engine 1 did not start because of, for example, the failure in spark-ignition or compression-ignition immediately after the first firing in this case, the crank angular acceleration (a) temporarily increases and then falls immediately. Thus, one of the first increment ($a_n-a_{n-2}$) calculated by the first increment calculator 7*b* and the second increment ($a_{n-1}-a_{n-2}$) calculated by the second increment calculator 7*c* does not become higher than the standard value $\Delta a_{st}$. This prevents erroneous determination of the start-up of the engine 1. On the contrary, if the spark-ignition or compression-ignition is successful in succession (i.e., two times in succession) immediately after the first firing, the crank angular acceleration (a) does not immediately fall, and the value of the crank angular acceleration (a) corresponding to the fuel injection volume is maintained. Accordingly, both of the first increment ($a_n-a_{n-2}$) and the second increment ($a_{n-1}-a_{n-2}$) exceed the standard value $\Delta a_{st}$. This can accurately detect the start-up of the engine 1.

(1) Thus, the above-described engine start determining apparatus determines whether the engine 1 has started using increments in the crank angular acceleration (a) when the motor generator 2 cranks the engine 1. Such a control configuration can rapidly detect accurate momentum of spontaneous revolution of the engine 1. This can therefore achieve short-time determination of the start-up of the engine 1 and can improve the accuracy of the determination at the same time.

Furthermore, the "increments in the crank angular acceleration (a)" used in the determination are provided in comparison with the crank angular acceleration ($a_{n-2}$) at the second-preceding stroke, so that an increment can be observed during at least one turn of the crank shaft. This can accurately determine the actual rotational momentum (rotational power, rotational strength) of the crank shaft and improve the accuracy of the determination.

(2) Moreover, the engine start determining apparatus calculates a first increment, which is an increment in the crank angular acceleration (a) between the second-preceding stroke and the current stroke, and a second increment, which is an increment in the crank angular acceleration (a) between the second-preceding stroke and the preceding stroke. The first and second increments both are increments from the crank angular acceleration ($a_{n-2}$) at the second-preceding stroke.

The calculation of the two increments thus uses the same base time providing the respective reference values for the increments, so that the state of the crank angular acceleration (a) at the current stroke and the state of the crank angular acceleration (a) at the preceding stroke can be evaluated on the same scale. This can accurately discriminate a state where the engine 1 has not started from a state where the engine 1 has started, and improve the accuracy of the determination of the engine start-up.

(3) In addition, the engine start determining apparatus calculates an increment for a single stroke and an increment for two strokes based on the crank angular accelerations a each calculated every stroke of the engine 1, as illustrated in FIG. 2. Such determination using the first and second increments can confirm a successive increase in the angular acceleration (a) of the crank shaft, and further improve the accuracy of the determination of the start-up of the engine 1.

(4) Additionally, the engine start determining apparatus determines the start-up of the engine 1 using the increments in the crank angular acceleration (a) calculated every stroke of the engine 1. This can accurately detect the rotational momentum during half-turn of the crank shaft of the four-cycle engine, and improve the accuracy of the start-up determination.

(5) Furthermore, the engine start determining apparatus establishes the standard value $\Delta a_{st}$ based on the amount of intake air and the number Ne of revolutions of the engine 1. Accordingly, the magnitude of rotational driving force provided to the crank shaft by combustion of the air-fuel mixture can be appropriately evaluated. This can determine accurate rotational momentum according to the combustion state of the engine 1, and improve the accuracy of the determination of the start-up of the engine 1.

[5. Modifications]

The embodiment described above may be modified without departing from the gist thereof. The individual features of the embodiments may be selectively employed as necessary or properly combined with one another.

For example, the determination of the start-up of a four-cylinder four-cycle engine is exemplified in the embodiments described above, but the embodiments may be applied to a single-cylinder engine or a six-cylinder engine. The start-up of the engine 1 is determined using an increment in the crank angular acceleration (a) calculated every stroke of the engine 1. This enables at least the rotational momentum to be exactly determined during a half-turn of the crank shaft and the accuracy of the start-up determination to improve.

In addition, the appropriate unit time for calculation of increments in the crank angular acceleration (a) should not be limited to the stroke period of the engine 1. For example, two increments may be acquired using a spark-ignition period or a compression-ignition period of the engine 1 as the unit time, to determine that the engine 1 has started when these increments exceed their respective standard value. Also, the crank angular acceleration (a) may be calculated based on a period for every combustion stroke of each cylinder (a period for every specific crank angle at the combustion stroke). In other words, the angular acceleration calculator 7*a* may calculate the crank angular acceleration (a) every spark-ignition period or compression-ignition period of the engine 1.

For example, for a six-cylinder four-cycle engine, the crank angular acceleration (a) is calculated every 120-degree rotation of the crank shaft. The rapid increase in the angular acceleration (a) of the crank shaft is assumed to be immediately after combustion of the air-fuel mixture in any of the six cylinders; hence, the determination of the start-up of the engine 1 uses an increment in the crank angular acceleration (a) calculated every spark-ignition period or compression-ignition period. This operation can detect an accurate combustion state and success or failure of spark ignition or compression ignition in individual cylinders, and improve the accuracy of the start-up determination.

Although the determination of the start-up of the engine 1 cranked by the motor generator 2 is precisely explained in the above embodiments, the engine 1 can be cranked by any driving device other than the motor generator 2. For example, a motor having only the motor function can start the engine 1 and can accurately determine the start-up of the engine 1 within a short time period by the start-up determination described above.

REFERENCE SIGNS LIST

1 engine
2 motor generator (dynamo-electric machine)
3 motor
4 clutch
5 battery
6 electronic controller
7 calculator
7*a* angular acceleration calculator
7*b* first increment calculator
7*c* second increment calculator
8 determiner
9 controller
10 vehicle
11 drive wheel
12 engine speed sensor
13 airflow sensor
14 vehicle speed sensor
Q flow rate
V speed
Ne number of revolutions of engine
a crank angular acceleration
$Ne_n$ current value of number of revolutions Ne
$Ne_{n-1}$ preceding value of number of revolutions Ne
$a_n$ current value of crank angular acceleration a
$a_{n-1}$ preceding value of crank angular acceleration a
$a_{n-2}$ second-preceding value of crank angular acceleration a
$(a_n-a_{n-2})$ first increment
$(a_{n-1}-a_{n-2})$ second increment
$\Delta a_{st}$ standard value The invention thus described, it will be obvious that the same may be varied in many ways. Such variations are not to be regarded as a departure from the scope of the invention, and all such modifications as would be obvious to one skilled in the art are intended to be included within the scope of the following claims.

The invention claimed is:

1. An engine start determining apparatus comprising:

an engine;

a clutch disposed in a power transmission path connecting between the engine and drive wheels, dividing the power transmission path into an engine-side path and a wheel-side path;

a motor connected to the wheel-side path; and a dynamo-electric machine connected to the engine-side path, rotating the engine while the clutch is disconnected and generating electric power when rotated by the engine;

a calculator programmed to:

control the dynamo-electric machine to rotate the engine so that a rotating speed of the dynamo-electric machine for spontaneous revolution of the engine becomes a predetermined speed, and calculate an increment in a crank angular acceleration of the engine every certain period from a base time after rotating the engine by the dynamo-electric machine, the base time being after start of fuel injection; and a determiner programmed to determine that the engine has started by the dynamo-electric machine rotating the engine when the increment in the crank angular acceleration calculated by the calculator exceeds a standard value after the dynamo-electric machine starts to rotate the engine, and after the crank angular acceleration decreases as a rotational speed of the engine approaches a rotational speed of the dynamo-electric machine, the determiner is programmed to further determine that the engine has started when the increments in the crank angular acceleration until an end of said certain period and until the end of a preceding certain period both exceed the standard value.

2. The engine start determining apparatus according to claim 1, wherein the calculator is programmed to further calculate the increment in the crank angular acceleration of the engine every period of a piston stroke.

3. The engine start determining apparatus according to claim 2, wherein the piston stroke of the engine is a spark-ignition period of the engine or a compression-ignition period of the engine.

4. The engine start determining apparatus according to claim 1, wherein the determiner is programmed to further set the standard value based on an amount of intake air of the engine and an angular velocity of a crank shaft.

5. The engine start determining apparatus according to claim 2, wherein the determiner is programmed to further set the standard value based on an amount of intake air of the engine and an angular velocity of a crank shaft.

6. The engine start determining apparatus according to claim 3, wherein the determiner is programmed to further set the standard value based on an amount of intake air of the engine and an angular velocity of a crank shaft.

* * * * *